US006561215B1

(12) United States Patent
Wakefield

(10) Patent No.: US 6,561,215 B1
(45) Date of Patent: May 13, 2003

(54) NATURAL GAS WELLHEAD ENCLOSURE

(75) Inventor: Marty Wakefield, Ft. Lupton, CO (US)

(73) Assignee: Hoad, Incorporated, Fort Lupton, CO (US)

( * ) Notice: Subject to any disclaimer, the term of this patent is extended or adjusted under 35 U.S.C. 154(b) by 0 days.

(21) Appl. No.: 10/013,027

(22) Filed: Dec. 7, 2001

(51) Int. Cl.[7] ..... F16L 5/00
(52) U.S. Cl. ..... 137/364; 137/377; 137/382
(58) Field of Search ..... 137/377, 382, 137/364

(56) References Cited

U.S. PATENT DOCUMENTS

| | | | | |
|---|---|---|---|---|
| 3,063,500 A | * | 11/1962 | Logan | 166/66.5 |
| 3,112,760 A | * | 12/1963 | Budd | 137/363 |
| 4,335,740 A | | 6/1982 | Boley | |
| 4,405,161 A | * | 9/1983 | Young et al. | 285/80 |
| 5,331,778 A | | 7/1994 | Mazpule et al. | |
| 5,743,289 A | * | 4/1998 | Griffin et al. | 137/341 |
| 5,921,043 A | | 7/1999 | McDonald | |
| 5,960,592 A | | 10/1999 | Lilienthal II et al. | |
| 6,009,673 A | | 1/2000 | Adams | |
| 6,058,660 A | | 5/2000 | Melton | |
| 6,102,230 A | | 8/2000 | Gould | |
| 6,176,046 B1 | | 1/2001 | Quine et al. | |

FOREIGN PATENT DOCUMENTS

| | | |
|---|---|---|
| EP | 0 481 246 A2 | 9/1991 |

* cited by examiner

*Primary Examiner*—A. Michael Chambers
(74) *Attorney, Agent, or Firm*—William F. Lang, IV; Eckert Seamans Cherin & Mellott, LLC

(57) ABSTRACT

An enclosure for natural gas wellheads includes a fixed enclosure portion and a removable enclosure portion. The removable enclosure portion facilitates access to the wellhead, while the fixed enclosure portion protects the wellhead's computer and meter systems. The enclosure provides ventilation to prevent accumulation of natural gas within the enclosure in the event of a leak, and electrical grounding to prevent static electricity discharges in the presence of natural gas.

12 Claims, 5 Drawing Sheets

NATURAL GAS WELLHEAD ENCLOSURE

BACKGROUND OF THE INVENTION

1. Field of the Invention

The present invention is an enclosure for natural gas wellheads, providing protection, ease of access to the wellhead components, electrical grounding, and ventilation to prevent danger in the event of leaks.

2. Description of the Related Art

Natural gas wellheads are frequently enclosed by either fiberglass enclosures that must be lifted off the wellhead to gain access to the various components, or with make-shift plywood structures. Such enclosures not only impede access to the wellhead, but may also fail to provide proper ventilation to permit natural gas to exit the enclosure in the event of a leak, and also fail to provide electrical grounding to prevent static electricity sparks in the presence of natural gas.

Various housings for wellheads have been proposed in an attempt to overcome some of these disadvantages. For example, U.S. Pat. No. 4,335,740, issued to J. W. Boley on Jun. 22, 1982, describes an underground wellhead bunker. Such an underground bunker does not provide the ease of access to the wellhead components that removal of a portion of the housing can provide.

U.S. Pat. No. 5,960,592, issued to P. F. Lilienthal, II, et al. on Oct. 5, 1999, describes a protective enclosure for outdoor equipment. The enclosure includes a plurality of hollow panels, which are assembled, and possibly filled, at the site of the equipment. The equipment is then installed within the cabinet. This enclosure fails to provide ease of installation over pre-existing equipment, and means for accessing and servicing this equipment.

U.S. Pat. No. 6,176,046, issued to T. G. Quine et al. on Jan. 23, 2001, describes a portable, pre-manufactured, modular natural gas delivery station. The delivery station will typically be a modular building including a gas metering and regulating room, an odorant room, a boiler room, an energy generation room, and an electrical and control room. These rooms will typically contain gas piping with a gas inlet and outlet, a metering unit, a heat exchanger, a natural gas-powered generator, and a control unit. The building described by this patent has no features to facilitate removal of a portion of the building for access to the equipment, for example, to perform additional drilling.

Examples of other enclosures include U.S. Pat. No. 5,331,778, issued to A. Mazpule et al. on Jul. 26, 1994, describing a portable enclosure; U.S. Pat. No. 5,921,043, issued to H. C. McDonald, on Jul. 13, 1999, describing a pre-fabricated enclosed building; U.S. Pat. No. 6,009,673, issued to E. D. Adams on Jan. 4, 2000, describing a modular hunting blind; U.S. Pat. No. 6,058,660, issued to W. F. Melton on May 9, 2000, describing a portable garage; U.S. Pat. No. 6,102,230, issued to S. Gould on Aug. 15, 2000, describing an enclosure system; and European Pat. Application 0,481,246 published Apr. 22, 1992, describing a public laboratory.

Accordingly, an enclosure for natural gas wellheads having various doors dimensioned and configured to permit access to the wellhead, removable enclosure portions to facilitate access to larger portions of the wellhead, ventilation, and electrical grounding is desired.

SUMMARY OF THE INVENTION

The present invention is an enclosure for natural gas wellheads having a fixed portion dimensioned and configured to be entered by a person, and a removable portion dimensioned and configured to enclose the wellhead itself.

The enclosure of the present invention is mounted on a base frame, with the fixed portion including a floor. The frame includes a channel on each side, dimensioned and configured to receive the sides of the removable portion, and a plurality of clamps dimensioned and configured to secure the removable portion to the frame. The removable enclosure portion includes a hatch dimensioned and configured to provide access to the wellhead, and a plurality of handles to facilitate removal and installation of the removable portion.

The fixed enclosure portion contains the total flow computer, the V-cone measurement meter, the water turbine measurement meter, and a building vent. The gas and water pipelines extending upward from the ground at the wellhead continue into the fixed portion of the enclosure, proceeding through the meters and onward to storage and/or distribution systems as is well-known in the art of natural gas extraction. An opening defined in one side of the fixed enclosure portion communicates with one end of the removable enclosure portion. The floor of the fixed enclosure portion includes a hole dimensioned and configured to permit the gas and water pipes to reenter the ground. The fixed enclosure portion also includes one or more vents to permit natural gas to exit the fixed enclosure portion, preventing build-up of natural gas within the enclosure if a leak should occur. Additionally, the enclosure includes grounding lugs dimensioned and configured to provide for the discharge of static electricity, thereby preventing electrical sparks from occurring in close proximity to the natural gas.

The wellhead enclosure of the present invention offers several advantages over presently known enclosures. The removable portion covering the wellhead itself permits performing simple operations, for example, cleaning strainers, or checking to ensure that the wellhead is working properly, by merely opening the hatch. More difficult operations, for example, redrilling the well, drilling the well to a deeper depth, or checking the water pump located within the well, are facilitated by removal of the removable enclosure portion. The total flow computer and meters are provided with the best possible protection from outside weather conditions and unauthorized tampering by their location within the fixed enclosure portion.

It is therefore an aspect of the present invention to provide a natural gas wellhead enclosure having a fixed portion dimensioned and configured to protect peripheral devices, and a removable enclosure portion dimensioned and configured to protect the wellhead itself.

It is another aspect of the present invention to provide a natural gas wellhead enclosure having means for ventilating the enclosure, thereby preventing build-up of natural gas within the enclosure in the event of a leak.

It is a further aspect of the present invention to provide a natural gas wellhead enclosure having electrical grounding, preventing static electricity discharges in the presence of natural gas.

These and other aspects of the invention will become apparent through the following description and drawings.

BRIEF DESCRIPTION OF THE DRAWINGS

Like reference numbers denote like elements throughout the drawings.

DETAILED DESCRIPTION

The present invention is an improved enclosure for natural gas wellheads.

Figure 1:
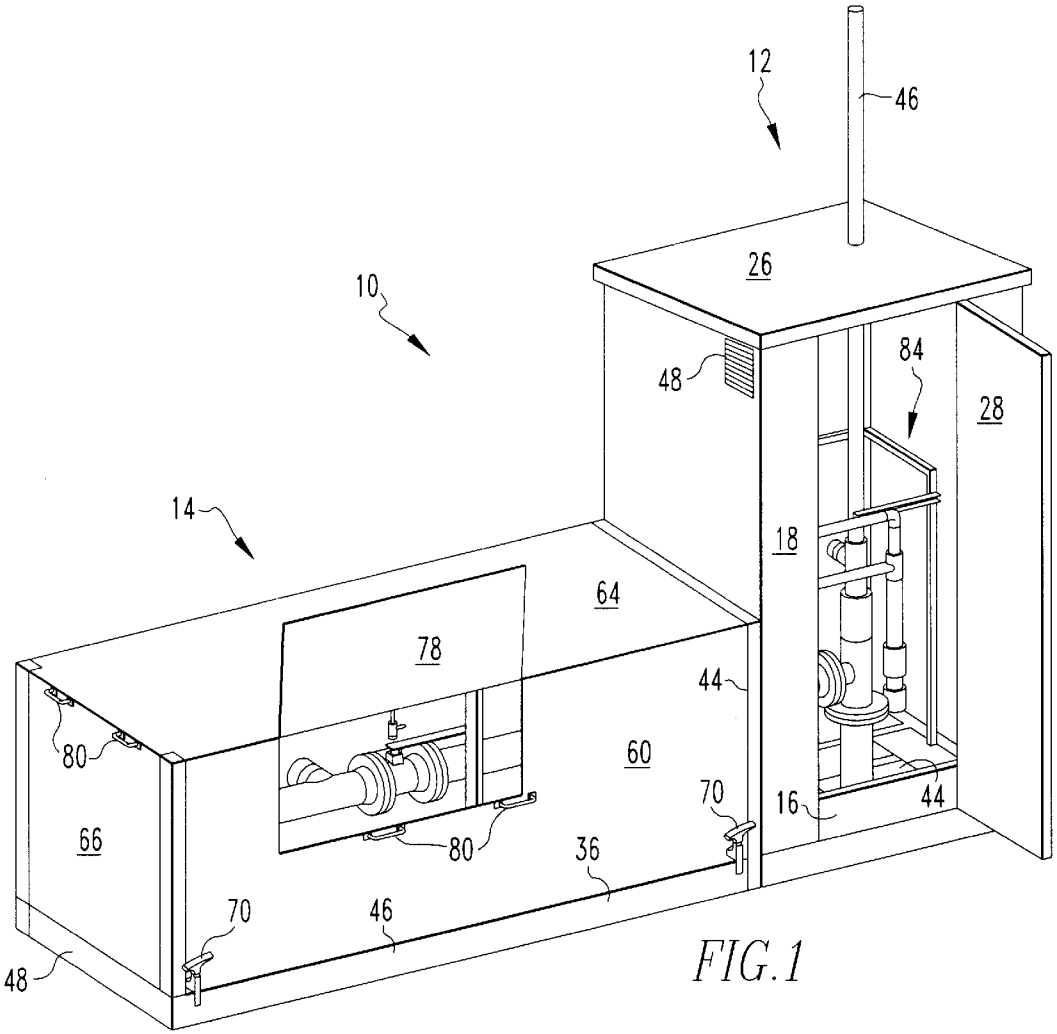
FIG. 1 is a front isometric view of a natural gas wellhead enclosure according to the present invention, illustrating the removable enclosure portion attached to the fixed enclosure portion.
Figure 2:
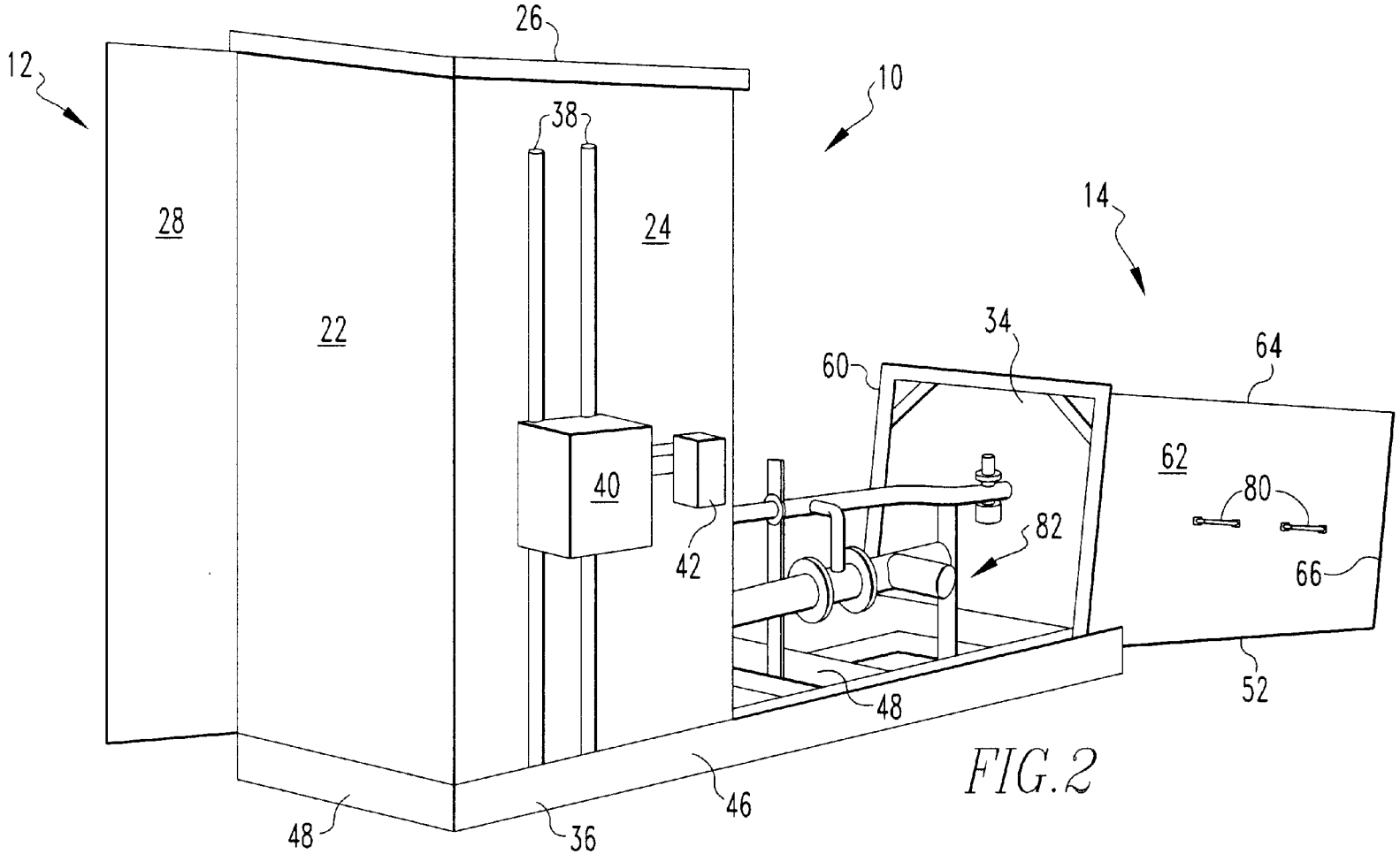
FIG. 2 is a rear isometric view of a natural gas wellhead enclosure according to the present invention, illustrating the removable enclosure portion removed.
Figure 3:
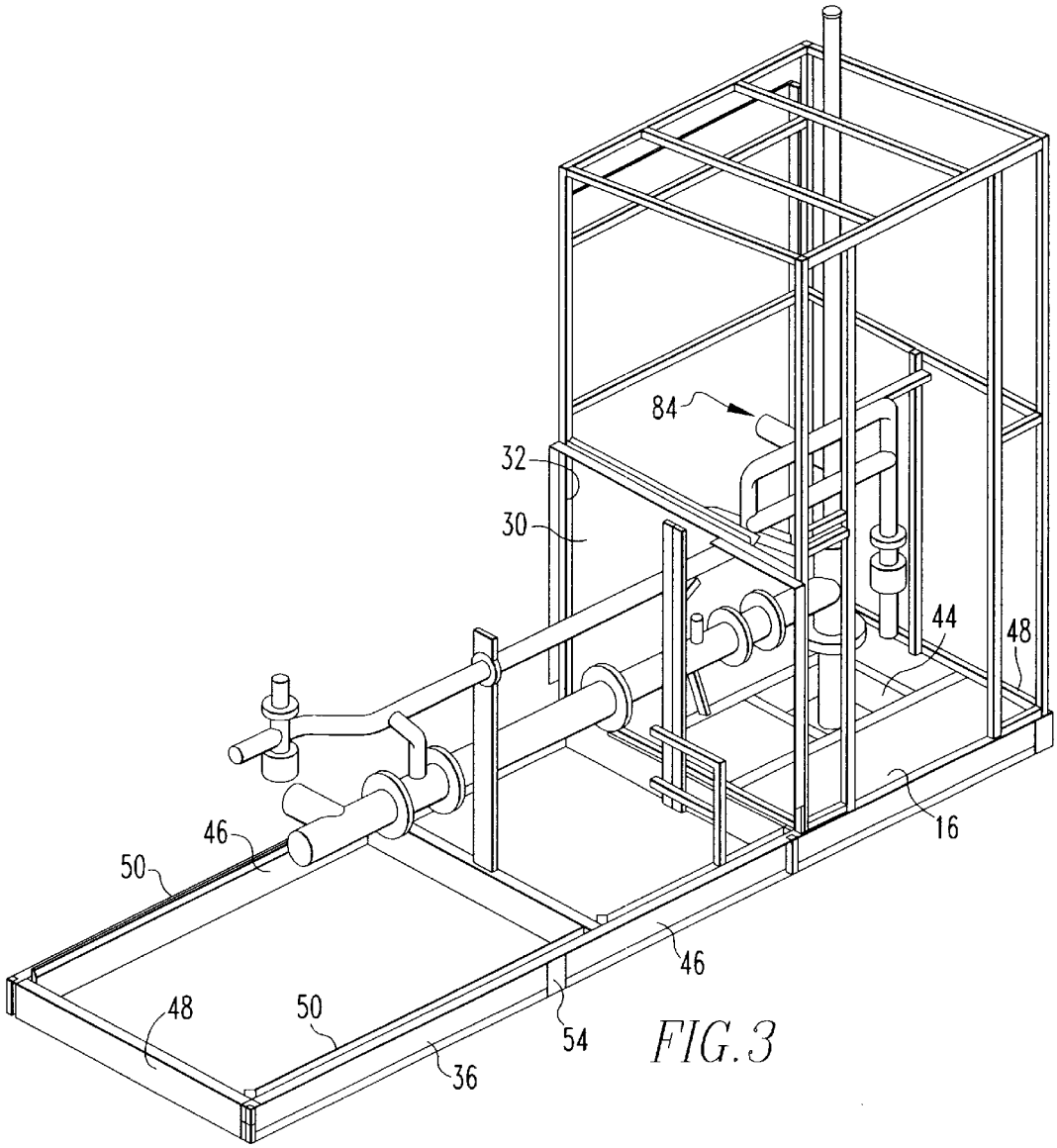
FIG. 3 is a front isometric view of the frame for a natural gas wellhead enclosure according to the present invention.
Figure 6:
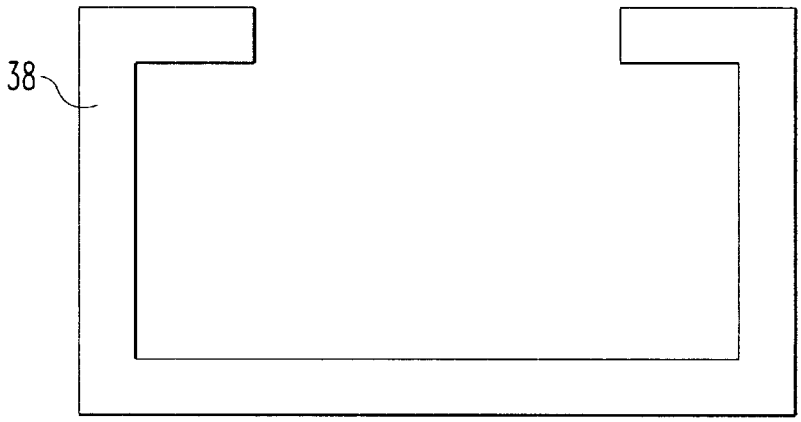
FIG. 6 is an end view of one of the two unistruts that may be utilized to secure peripheral devices to a natural gas wellhead enclosure according to the present invention.

Referring to FIGS. 1 and 2, the wellhead enclosure 10 includes a fixed enclosure portion 12, and a removable enclosure portion 14. The fixed enclosure portion 12 includes a floor 16, a front 18, a pair of sides 20, 22, a back 24, and a ceiling 26. The front 18, sides 20, 22, and back 24, which may be made out of a strong, rigid material, for example, steel, and may include insulation, for example, foil insulation, on their inner surfaces. A door 28 is provided to permit a person to enter the enclosure 12. Referring to FIG. 3, the fixed enclosure 12 also defines an opening 30, dimensioned and configured to communicate with the removable enclosure portion 14. The opening 30 may be surrounded by a guide lip 32, dimensioned and configured to fit just inside and/or abut the open end 34 of the removable enclosure 14. The door 28 and opening 30 may be located on any of the front 18, side 20, side 22, or back 24 of the fixed enclosure portion 12, provided that the door 28 and opening 30 should not be located on the same panel 18, 20, 22, 24, and the opening 30 should correspond to the portion of the support frame 36 extending under the removable enclosure portion 14. The fixed enclosure portion 12 may also include a pair of unistruts 38 (FIGS. 2, 6), dimensioned and configured to secure peripheral devices, for example, the driver 40 and circuit breaker 42. The floor 16 defines an opening 44, dimensioned and configured to permit piping to enter the ground. The fixed enclosure portion 12 also includes one or more vents 46, 48.

Figure 5:
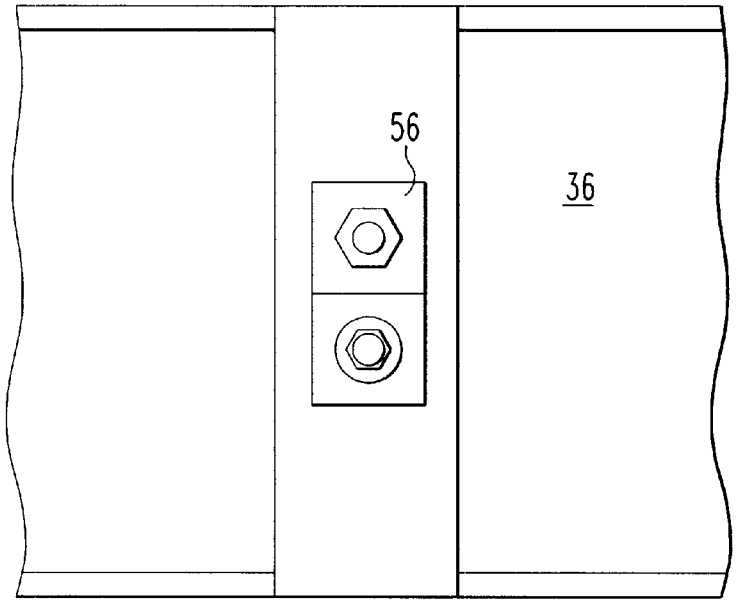
FIG. 5 is a front view of a grounding lug for a natural gas wellhead enclosure according to the present invention.

The support frame 36, best illustrated in FIG. 3, supports the entire enclosure 10, extending underneath both the fixed enclosure portion 12 and removable enclosure portion 14. The support frame 36 preferably includes a pair of main beams 47, connected by a plurality of cross beams 49. The main beams 47 may include a guide lip 50, dimensioned and configured to fit within and/or abut the inside of the bottom 52 of the removable enclosure portion 14. The frame 36 may also include reinforcement plates, and electrical grounding lugs 56 (FIG. 5). A plurality of pipe support members 58 may extend upward from the frame 36.

Referring back to FIGS. 1 and 2, the removable enclosure portion 14 includes a front 60, a back 62, a top 64, and one end 66, which are preferably made from a strong, rigid material, for example, steel. The end 34 opposite the end 66 is open, providing for communication between the fixed enclosure portion 12 and removable enclosure portion 14 through the opening 30. The removable enclosure portion 14 includes at least one hatch 68, dimensioned and configured to permit access to the interior of the enclosure 14. In the present example, the hatch 68 is illustrated as being defined within the front panel 60. Alternative embodiments could include the hatch 68, or additional hatches within the end panel 66, top panel 64, or back panel 62.

Figure 4:
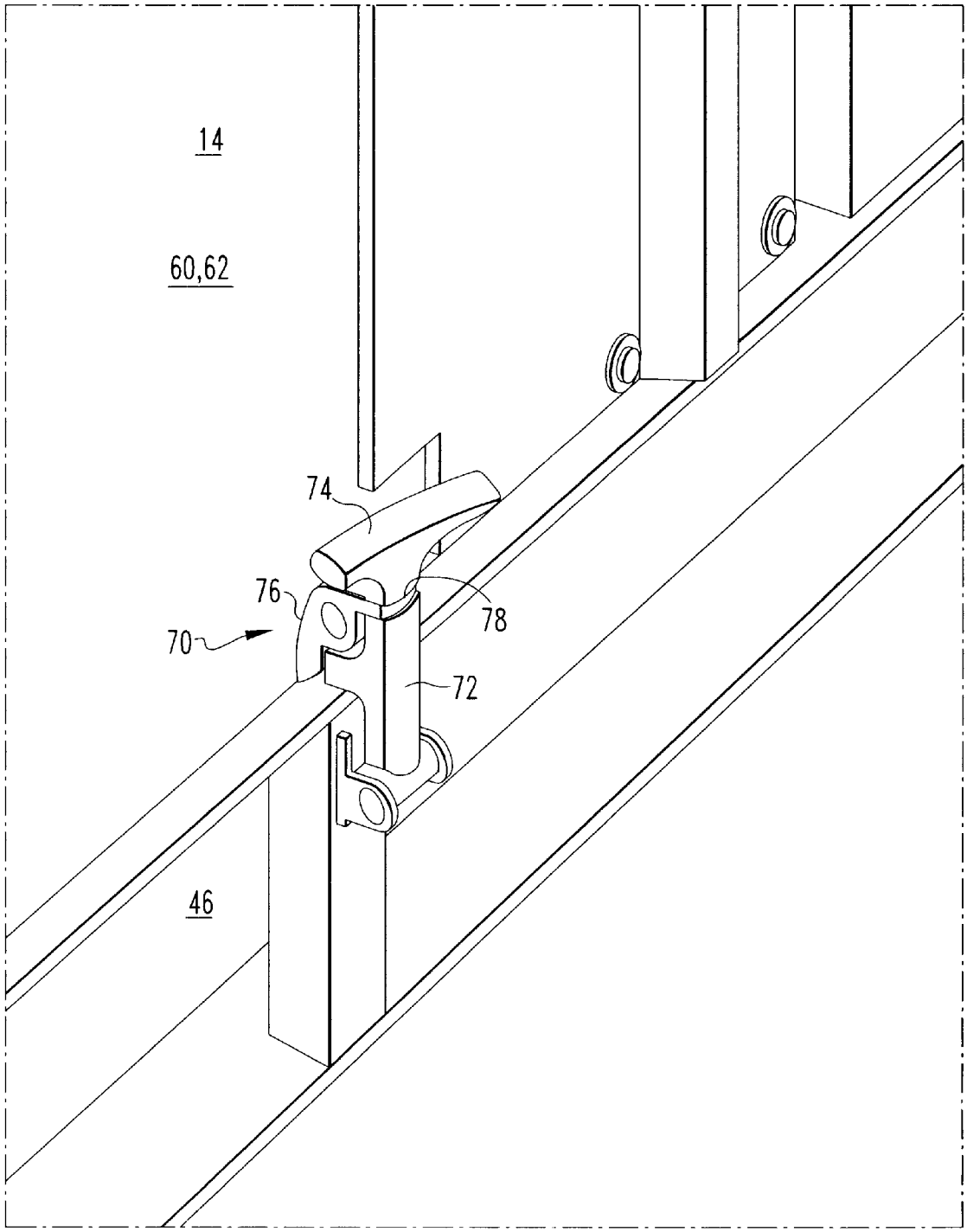
FIG. 4 is an isometric view of a clamp for securing the removable enclosure portion of a natural gas wellhead enclosure according to the present invention to its support frame.

The removable enclosure portion 14 is secured to the support frame 36 on which it sits by a plurality of clamps 70, best illustrated in FIG. 4. One example of a preferred clamp includes a longitudinal member 72, pivotally secured to a main beam 47, and having a handle 74 at its upper end. A catch 76 secured to either the front 60 or back 62 of the removable enclosure portion 14, is dimensioned and configured to mate with a channel 78 defined around the circumference of the elongated member 72. The removable enclosure portion 14 preferably also includes a plurality of handles 80, which in the illustrated example are located on the front 60, back 62, and end 66.

In use, the removable enclosure portion 14 will cover the wellhead 82, and the fixed enclosure portion 12 will enclose the wellhead peripherals 84. If a gas leak should occur, natural gas will exit the enclosure 10 through the vents 46, 48, instead of building up within the enclosure 10. A person wishing to check the total flow computer, V-cone measurement meter, water turbine measurement meter, or peripheral devices 84, may open the door 28, and enter the fixed enclosure portion 12 to do so. Likewise, a person wishing to clean the strainer or verify proper operation of the wellhead may open the hatch 68 to do so. If more extensive work on the wellhead 82 is desired, for example, redrilling the well, drilling the well to a deeper depth, or checking the water pump within the well, the removable portion 14 may be removed. Preferably, the removable portion 14 weighs less than approximately 200 lb., so that it can be removed by one or two people. First, the clamps 70 are unclamped. Second, the removable enclosure 14 is raised and carried, or dragged, from the position illustrated in FIG. 1 wherein it is on top of the support frame, to the position illustrated in FIG. 2, wherein it is substantially removed from the support frame 36. A pair of individuals may completely lift the removable enclosure portion 14 off of the support frame 36 or the ground utilizing the handles 80 on the front 60 and back 62. Alternatively, a single individual may drag the removable enclosure portion 14 off of the support frame 36, and return it to its position on the support frame 36, utilizing the handles 80 on the end 66.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An enclosure for natural gas wellheads, the wellheads including a wellhead portion and a peripheral device portion, said enclosure comprising:

a fixed enclosure portion having a front wall, a pair of side walls, a back wall, and a ceiling, the fixed enclosure portion being dimensioned and configured to enclose said peripheral device portion; and a removable portion having a front wall, a back wall, a top, and one end wall, the removable portion being dimensioned and configured to enclose said wellhead portion, said removable portion being in communication with said fixed portion through an opening defined within said fixed enclosure portion.

2. The enclosure according to claim 1, further comprising a floor within said fixed enclosure portion, said floor defining at least one opening dimensioned and configured to permit passage of pipes associated with said wellhead.

3. The enclosure according to claim 1, further comprising a support frame dimensioned and configured to fit beneath said fixed enclosure portion and removable enclosure portion.

4. The enclosure according to claim 3, further comprising a pair of guide lips on said support frame, said guide lips being dimensioned and configured to locate said removable enclosure portion on said support frame.

5. The enclosure according to claim 3, further comprising a plurality of clamps dimensioned and configured to removably secure said removable enclosure portion to said support frame.

6. The enclosure according to claim 1, further comprising a door defined within said fixed enclosure portion.

7. The enclosure according to claim 1, further comprising at least one vent within said fixed enclosure portion.

8. The enclosure according to claim 1, further comprising at least one hatch defined within said removable enclosure portion.

9. The enclosure according to claim 1, wherein said removable enclosure portion has a weight not exceeding approximately 200 lb.

10. The enclosure according to claim 1, wherein said removable enclosure portion further comprises at least one handle dimensioned and configured to facilitate lifting or dragging said removable enclosure portion.

11. The enclosure according to claim 1, further comprising at least one electrical grounding lug.

12. The enclosure according to claim 1, further comprising insulation within said fixed enclosure portion.

* * * * *